United States Patent [19]

Williams

[11] 4,143,663

[45] Mar. 13, 1979

[54] SACRO-LUMBAR GARMENT

[75] Inventor: Marguerite R. Williams, Trumbull, Conn.

[73] Assignee: Surgical Appliance Industries, Inc., Cincinnati, Ohio

[21] Appl. No.: 849,232

[22] Filed: Nov. 7, 1977

[51] Int. Cl.[2] ..... A41C 1/00

[52] U.S. Cl. ..... 128/527

[58] Field of Search ..... 128/527, 528, 539, 555, 128/556, 573

[56] References Cited

U.S. PATENT DOCUMENTS

| | | | |
|---|---|---|---|
| 2,070,515 | 2/1937 | Miller, Jr. et al. | 128/527 |
| 2,104,277 | 1/1938 | Schopbach | 128/556 |

*Primary Examiner*—Werner H. Schroeder
*Assistant Examiner*—Doris L. Troutman
*Attorney, Agent, or Firm*—Wood, Herron & Evans

[57] ABSTRACT

A trunk-encircling garment for providing sacro-lumbar support having a vertical slit in the central lower front panel thereof flanked on either side with fasteners for either maintaining the slit in a closed position to produce a girdle style garment, or connecting to one end of a removable crotch panel the other end of which connects to the rear of the garment to produce a panty style garment. Elastic inserts in the garment proximate the lower edge thereof assure snug thigh-encircling action when the removable crotch panel is attached and the garment converted to a panty style.

6 Claims, 6 Drawing Figures

SACRO-LUMBAR GARMENT

This invention relates to sacro-lumbar support garments, and more particularly to such garments having the capability of being easily converted between girdle style and panty style.

Sacro-lumbar support garments are designed to snugly encircle the trunk of the wearer in the region extending vertically between points above the waist and below the crotch. Such garments typically have stays in the rear panel for providing support for the sacro-lumbar region of the wearer. Some form of lacing is also usually provided to enable the girth of the garment in the sacro-lumbar region to be adjusted to provide a snug fit for firm support.

Depending on the preferences of the wearer, the sacro-lumbar garment has typically been designed as either a girdle style, i.e., with a single opening in the lower portion encircling both thighs, or a panty style, i.e., with two separate openings in the lower portion for individually encircling the thighs. To reduce the inventory requirements of orthopedic appliance distributors, it is desirable to provide a single sacro-lumbar support garment which can be utilized, at the discretion of the wearer, as either a panty style or girdle style support garment. Such a garment, which is convertible at the will of the wearer between girdle and panty styles, in addition to reducing inventory requirements, also provides an advantage to the purchaser in that a purchaser can periodically convert the garment from one style to another as desired.

It has been an objective of this invention to provide a sacro-lumbar garment which is conveniently, easily and quickly convertible between panty and girdle styles, and yet which provides a snug fit to the wearer's thighs in both the girdle mode and the panty mode. This objective has been accomplished in accordance with the principles of this invention by providing a tubular trunk-encircling support garment with a slit in the lower front panel thereof extending from the bottom edge to the crotch. The slit is flanked on either side thereof with fasteners. When the fasteners flanking the edges of the garment front panel which define the slit are engaged with each other to close the slit, a girdle style garment with a single opening in the bottom encircling both thighs is provided. Also included is an array of fasteners disposed generally horizontally along the rear of the garment at a point sufficiently close to the lower edge to avoid sitting on the fasteners when the wearer is in a seated position, and a selectively removable crotch panel having fasteners along its front and rear edges. When it is desired to convert the garment to a panty, the crotch panel is connected between the horizontal array of fasteners on the rear panel and the fasteners flanking both sides of the open slit in the front panel, thereby forming two openings in the lower region of the garment which individually embrace the thighs. To provide a snug fit around the wearer's thighs when the crotch panel is attached to form a panty, elastic inserts are provided in the garment between the lower edge thereof and the crotch.

In a preferred embodiment of the invention, the elastic inserts extend from the lower edge of the garment upwardly to a height approximating that of the crotch, and are triangularly shaped and disposed to provide increasing elasticity in a body encircling direction as the lower edge of the garment is approached from the direction of the crotch. In this way, the greatest elasticity is provided at the lowermost extremity of the thigh-encircling portions of the garment when the crotch panel is attached to form a panty, which lowermost extremity corresponds to the point where the greatest circumferential separation exists between the vertical edges of the front panel which define the vertical slit. Correspondingly, the triangular elastic inserts provide the least circumferential elasticity at a height corresponding to the crotch where the horizontal spacing between the slit-defining edges of the front panel approaches zero.

These and other features, advantages, and objectives of the invention will become more readily apparent from a detailed description thereof taken in conjunction with the drawings in which.

Figure 1:
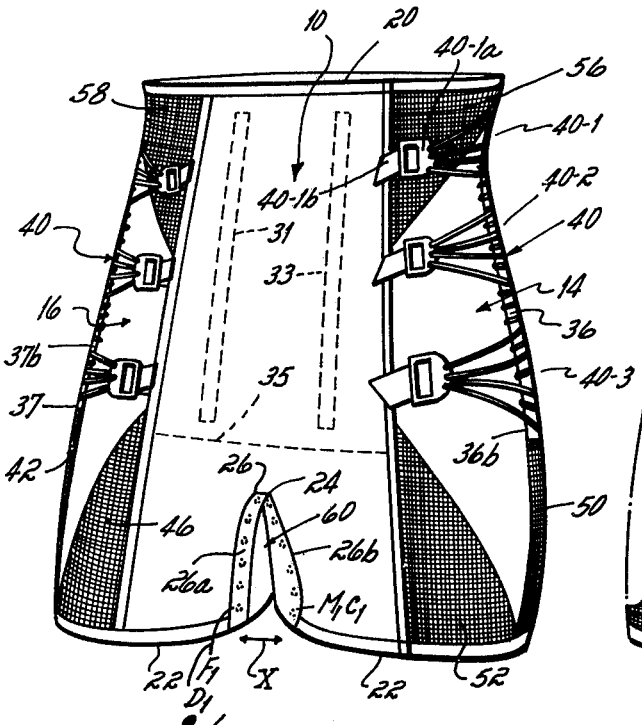
FIG. 1 is a front perspective view of the sacro-lumbar garment of this invention with the removable crotch panel attached to provide a panty style garment.
Figure 2:
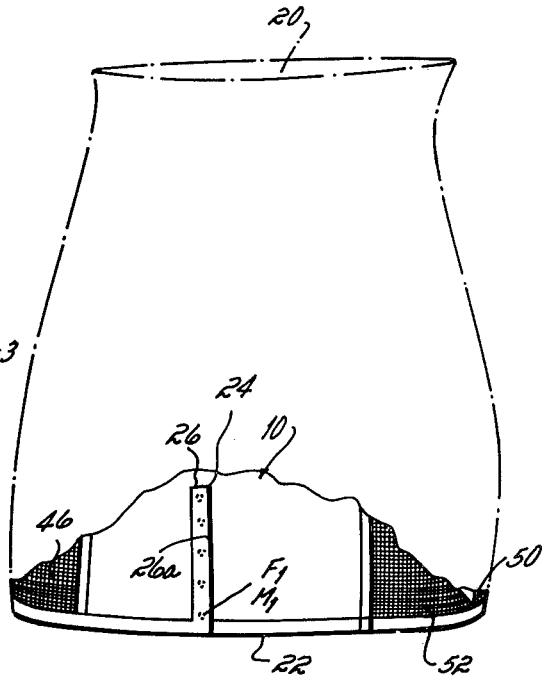
FIG. 2 is a front perspective view of the lower portion of the garment of this invention showing the removable crotch panel unattached and the slit in the front panel closed to provide a girdle type garment.
Figure 3:
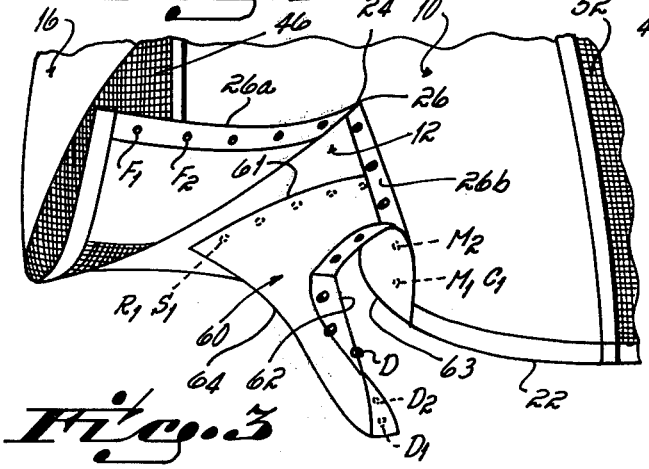
FIG. 3 is a front perspective view of the lower portion of the garment of this invention showing the slit in the front panel in the open position and the crotch panel partially attached thereto.
Figure 6:
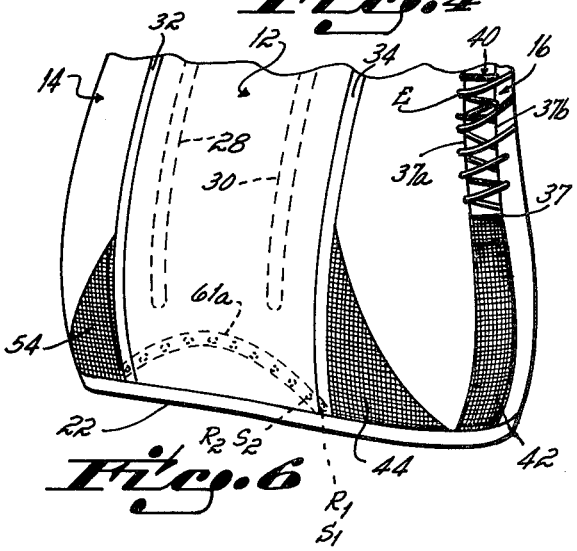
FIG. 6 is a rear perspective view of the lower portion of the garment of this invention.

With reference to FIGS. 1, 2 and 6, the garment of this invention is seen to include a front panel 10, a rear panel 12, a left side panel 14 and a right side panel 16. The panels 10, 12, 14 and 16 are interconnected to form a generally tubular garment designed to encircle the trunk of a wearer. Panels 10, 12, 14 and 16 are permanently connected by stitching, except along line 10L where fasteners (not shown) such as cooperating hooks and eyes, are provided to facilitate placement and removal of the garment about the wearer's trunk. The height of the panels 10, 12, 14 and 16 are selected such that when the tubular garment encircles the wearer's trunk, the upper edge 20 of the garment extends vertically upwardly to a point proximate the wearer's waist and preferably to a point two or three inches above the waist, while the lower edge 22 of the garment extends vertically downwardly to a point below the wearer's crotch, preferably 2–6 inches below the wearer's crotch. The front, rear and side panels 10, 12, 14 and 16 are primarily fabricated of material which is inelastic; however, for reasons which will become more apparent hereafter, the left and right side panels 14 and 16 are each provided with elastic inserts of a preferred shape, location and orientation to be described in more detail hereafter.

Figure 4:
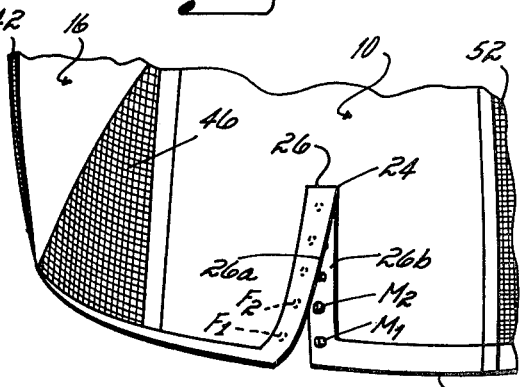
FIG. 4 is a perspective view of the lower portion of the garment of this invention showing the removable crotch panel detached and the slit in the front panel partially open.

The front panel 10 is slit vertically in the central portion thereof as shown by reference numeral 24, from the lower edge 22 to a point 26 proximate the wearer's crotch. The slit line 24 defines a pair of confronting vertical edges **26*a* and 26*b*. Cooperating fastening means $F_1$, $F_2$, . . . and $M_1$, $M_2$, . . . are provided on the edges 26*a* and 26*b*. Fasteners $F_1$, $F_2$, . . . and $M_1$, $M_2$, . . . are selectively engageable with each other, to in turn engage the edges 26a and 26b with each other to close the slit 24, as shown in FIG. 2. Alternatively, when the fastening means on the edges 26a and 26b are not engaged with each other, the slit 24 is in an open condition, either fully or partially, depending upon the extent to which the fastening means on edges 26a and 26b are disengaged. Partial disengagement facilitating partial opening of the slit 24 is shown in FIG. 4, while full disengagement facilitating a fully opened slit 24 is shown in FIG. 1. Full engagement of the fastening means $F_1$, $F_2$, . . . and $M_1$, $M_2$, . . . with each other shown in FIG. 2 typifies use of the garment as a girdle style sacro-lumbar support. Whereas, full disengagement of the fastening means $F_1$, $F_2$, . . . and $M_1$, $M_2$, . . . with each other shown in FIG. 1** typifies use of the garment as a panty style sacro-lumbar support.

The fastening means $F_1$, $F_2$, . . . and $M_1$, $M_2$, . . . associated with edges 26a and 26b in one preferred form include a plurality of spaced pins disposed in a vertical row which are circumferentially grooved and a corresponding plurality of spaced pin-gripping apertured elements disposed in a vertical line for gripping the corresponding aligned pins when inserted therein. The circumferentially grooved pins, or male fastening elements, may be provided on front panel vertical edge 26b as indicated by reference numerals $M_1$, $M_2$, . . . , while the apertured pin-gripping fastening elements, or female fasteners, may be secured to the front vertical edge 26a as shown by reference numerals $F_1$, $F_2$, . . . . Obviously, male fasteners $M_1$, $M_2$, . . . engage female fasteners $F_1$, $F_2$, . . . , respectively. Other types of fasteners could also be used, e.g. Velcro, hooks and eyes, nylon zipper, etc.

The rear panel 12, which is generally rectangular in shape, is preferably fabricated of inelastic material throughout its entirety. Secured to the interior surface of the rear panel 12 are a pair of elongated reinforcing stays 28 and 30. Stays 28 and 30 are vertically disposed and spaced horizontally from each other. Preferably these stays 28 and 30 are positioned in place by locating them in elongated fabric pockets sewn to the interior of the rear panel 12, as is well known in the art. If desired, an additional pair of elongated stays 32 and 34 can be secured to the interior of the rear panel 12 along the opposite edges thereof where the rear panel joins the left and right side panels 14 and 16. The front panel 10 has a pair of stays 31 and 33 secured to an inelastic panel 35 which underlies front panel 10. Panel 35 is stitched to panel 10 along the upper two-thirds of panel edges 10L and 10R. Thus, panel 35 is coextensive with and underlies the upper two-thirds of front panel 10.

Each of the side panels 14 and 16 is provided with an elongated slot 36 and 37 defined by horizontally spaced apart pairs of edges 36a, 36b and 37a and 37b, respectively. Since slots 36 and 37 are identical except that they are positioned in opposite sides 14 and 16 of the garment, only slot 37 is discussed in detail. As shown in FIGS. 1 and 6, the slot 37 extends vertically downwardly to a point approximating the same elevation as the wearer's crotch. Stated differently, the lower extremity of the slot 37 is spaced from the lower edge 22 of the garment a distance approximately equal to the distance between the lower edge 22 and the crotch point 26. The upper edge of the slot 37 is located at a point slightly below the upper edge 20 of the garment. Located on either side of the slot edges 37a and 37b are sets of eyelets E, E, . . . . A lace means 40 threading the eyelets E is provided to selectively adjust the horizontal spacing of the slot-defining edges 37a and 37b and in turn the circumferential measurement or girth of the garment. Preferably, the lace means 40 is in the form of three separate laces 40-1, 40-2 and 40-3 to facilitate separate control of the spacing of the slot-defining edges 37a and 37b at upper, middle and lower portions of the slot 37.

The laces 40-1, 40-2 and 40-3 are constructed and operate identically. For example, the lace 40-1 threads back and forth through eyelets E on opposite side edges 37a and 37b of slot 37 along the upper one-third of the slot. The ends of the lace 40-1 as well as an intermediate portion thereof, are secured to a metal buckle 40-1a. The metal buckle 40-1a in turn is secured to the left vertical edge 10L of the front panel 10 via a band 40-1b. Band 40-1b has one end fixedly connected to the front panel 10 and its other end adjustably connected to the buckle 40-1a. By pulling the free end of the band 40-1b leftwardly the position of the buckle 40-1a can be positioned closer to the left vertical edge 10L of the front panel 10, thereby tightening the lace 40-1 which in turn urges the upper portions of the edges 37a and 37b closer together to reduce the girth of the garment along the upper portion thereof. Laces similar to 40-1, 40-2 and 40-3 are provided in association with slot 36 to facilitate additional girth adjustment capability for the garment.

Located in the right side panel 16 below and contiguous to the slot 37 is a rectangular elastic insert 42 which extends from the lower edge 22 of the right side panels 16 to a point approximating the height of the crotch, that is, to the lower end of the slot 37. Also formed in the right side panel 16 along the lower portion thereof between the lower edge 32 and the crotch, are a pair of triangular elastic inserts 44 and 46. Insert 44 is located in the rear portion of the right side panel 16 between the stay 34 and the central elastic panel 42 while elastic insert 46 is located in the front portion of the right side panel 16 between the central insert 42 and the right hand edge 10R of the front panel 10. The inserts 44 and 46 taper from the lower edge 22 of the garment toward the crotch. That is, the horizontal dimension of the elastic inserts 44 and 46 is greatest at the lower edge 22 of the garment and gradually decreases as the distance from the lower edge increases. Thus, the elastic inserts 44 and 46 provide for increasing elasticity in a circumferential direction as the lower edge 22 of the garment is approached in a direction from the crotch toward the lower edge. The utility of the circumferential elasticity in the garment, particularly in the side panels 14 and 16 proximate the lower edge 22 will become more apparent hereafter.

The left side panel 14, like the right side panel 16, is provided with a central rectangular elastic insert 50 extending from the lower edge 22 upwardly to the lower end of the left vertical slot 36. Similarly, the left side panel 14 is provided with a front triangular elastic insert 52 and a rear triangular elastic insert 54 which correspond in size, position and function to the elastic inserts 46 and 44 formed in the right side panel 16. Inserts 42, 44, 46 and 50, 52, 54 are preferably fabricated of an elastic which stretches only in a horizontal, or circumferential, direction.

If desired, the upper portion of side panels 14 and 16 can be provided with elastic inserts 56 and 58, also triangular in form, with the greatest elasticity being proximate the upper edge 20. Elastic inserts 56 and 58 promote snug encirclement of the upper portion of the tubular garment about the waist region of the wearer.

Figure 5:
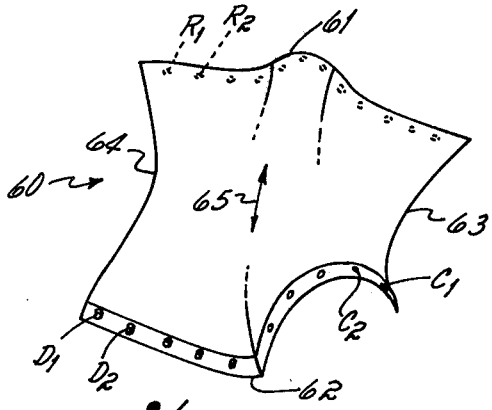
FIG. 5 is a perspective view of the removable crotch panel.

As shown in FIG. 5, the garment of this invention also includes a removable crotch panel 60 which has a rear edge 61, a front edge 62, a left edge 63 and a right edge 64. The crotch panel 60 is preferably elastic and stretchable only in the direction of arrow 65. The width of the panel 60, measured between left and right edges 63 and 64, preferably gradually reduces as the center of the panel is approached from both the rear edge 61 and the front edge 62. Thus, the edges 63 and 64 curve inwardly. The edges 61 and 62 preferably curve slightly outwardly.

A plurality of spaced fasteners, such as grooved pins, or male fastening elements, are provided along the rear edge 61, as shown by reference numerals $R_1$, $R_2$, . . . . A plurality of cooperating, pin-gripping, female fastening elements designated with reference numerals $S_1$, $S_2$, . . . are provided along the interior of the rear panel 12 in an arcuate or curved pattern 61*a* corresponding to the curve of the rear edge 61 of the crotch panel 65. Preferably, the fasteners $S_1$, $S_2$, . . . , which cooperate with fasteners $R_1$, $R_2$, . . . to secure the rear edge 61 of the crotch panel to the rear panel 12 of the garment when a panty style is desired, are provided at a point sufficiently close to the lower edge 22 of the garment to avoid the wearer from sitting on the engaged fasteners $R_1S_1$, $R_2S_2$, . . . when in a seated position. The lower ends of the stays 28 and 30 provided in the rear panel 12 preferably do not extend to the curved array of fasteners $S_1$, $S_2$, . . . which serves to secure crotch panel rear edge 61 to the rear panel 12, but preferably are spaced 1–2 inches thereabove.

The front edge 62 of the removable crotch panel 60 is provided with a plurality of pin-gripping female fasteners $C_1$, $C_2$, . . . on the right hand portion thereof, while the left hand portion is provided with a plurality of grooved pins or male fastening elements $D_1$, $D_2$, . . . when a panty style is desired, the crotch panel is attached. Specifically, the female fastening elements $C_1$, $C_2$, . . . along the left hand portion of the crotch panel front edge 62 are engaged with the male pins $M_1$, $M_2$ . . . along the front vertical edge 26*b* of front panel slit 24 to secure edge 26*b* to the left hand portion of the front edge 62. Similarly, the male fastening elements $D_1$, $D_2$, . . . on the right hand portion of crotch panel edge 62 are engaged with female fasteners $F_1$, $F_2$, . . . on front panel vertical edge 26*a* of slit 24 to secure this latter edge to the right hand portion of edge 62 of the removable crotch panel 60. With crotch panel edge 61 secured to the lower portion of the rear garment panel 12, and with the left and right hand portions of crotch panel front edge 62 secured to the front panel left and right vertical edges 26*b* and 26*a* of the slit 24, the crotch panel spans the front and rear panels 10 and 12 to form a panty style sacro-lumbar garment.

When the crotch panel is secured to the front and rear panels 10 and 12, the elastic inserts 40, 42 and 44 in the right side panel 16 cause the right leg-defining portions of the crotch panel 60, right panel 16 and front panel 10 and rear panel 12 to snugly encircle the wearer's right thigh. Similarly, elastic inserts 50, 52 and 54 in the left side panel 14 cause the left leg-defining portion of the crotch panel 60, front panel 10, rear panel 12 and left side panel 14 to snugly grip the wearer's left thigh. With the crotch panel inserted, a panty results.

When a girdle style is desired, the crotch panel 60 is disconnected from the rear panel 12 and the slit-defining edges 26*a* and 26*b* of front panel 10, and the fasteners $M_1$, $M_2$, . . . of edge 26*b* are engaged with fasteners $F_1$, $F_2$, . . . of slit edge 26*a* to close the slit 24 in the front panel 10. The garment is now converted to a girdle type sacro-lumbar support.

When the removable crotch panel 60 is attached, the slit 24 is in its open condition shown in FIG. 1. In such position, the confronting slit edges 26*a* and 26*b* at their lowermost point are separated by a distance "X". By virtue of this separation, the circumference of the lower edge of the garment 22, when the garment is used as a panty style with the crotch panel 60 attached, exceeds the circumference of the lower edge 22 when the garment is used in a girdle style with the crotch panel detached. To accommodate for the increased circumference of the lower edge of the garment when used as a panty style, and still permit the thighs to be snugly gripped by the thigh encircling portions of the garment, the elastic inserts 50, 52, 54 and 42, 44 and 46 are provided. Stated differently, elastic inserts 50, 52 and 54 and 42, 44 and 46 enable the lower edge of the garment to snugly grip the thighs which they encircle when the garment is used in its panty style mode even though the circumference of the lower edge of the garment is increased by a distance "X" in comparison to that which exists when the garment is used as a girdle and slit 24 is closed. Since slit 24 is in the form of an inverted "V" when the crotch panel 60 is attached to form a panty style support, the horizontal distance or separation between edges 26*a* and 26*b* decreases as the crotch is approached from the direction of the lower edge 22. To accommodate this decreasing separation, and in turn decreasing circumference of the garment, and yet provide uniform girth vertically between the crotch and the lower edge 22, the shape of inserts 44, 46, 52 and 54 is tapered to provide decreasing elastic material as the crotch is approached from lower edge 22. Such tapering is accomplished by triangulation of the inserts 44, 46, 52, 54 and orienting each with its apex uppermost and its base lowermost.

If desired, the slit 24 could be placed in the center of the rear panel. However, if the slit 24 were placed in the rear panel 12 rather than in the front panel 10, its vertical dimension would have to be increased in comparison to that which exists when the slit 24 is placed in the front panel.

Thus having described the invention, what is claimed is:

1. A convertible sacro-lumbar garment selectively usable with and without a removable crotch panel to provide panty and girdle styles, respectively, comprising:

front, rear, right and left side panels interconnected to form a generally tubular shaped garment for encircling the trunk of a wearer, said panels each being substantially inelastic and extending vertically upwardly to a point proximate the wearer's waist and extending vertically downwardly to a point below the wearer's crotch, said front panel being slit in the central portion thereof from the lowermost edge thereof upwardly to a point above the wearer's crotch, said slit defining confronting vertical edges in said front panel, a removable crotch panel having a front and a rear edge, first fastener means on said confronting edges of said front panel to selectively maintain said slit in a closed condition to form a girdle style garment when said crotch panel is absent, second fastener means secured to the interior of said rear panel, at a point sufficiently close to the lower edge thereof to avoid sitting on said second fastener means when said wearer is in a seated position, front and rear fasteners on said front and rear edges of said removable crotch panel selectively cooperable with said first and second fastener means on said front and rear panels, respectively, for securing said crotch panel between said front and rear panels to convert said garment to a panty style, a left elastic means formed in at least one of said left side, front or rear panels proximate the lower edge thereof to facilitate snug encirclement of said left thigh by said crotch panel and the lower edges of said left side, front and rear panels when said crotch panel is secured to said tubular shaped garment to form a panty style garment, and a right elastic means formed in at least one of said right side, front or rear panels proximate the lower edge thereof to facilitate snug encirclement of said right thigh by said crotch panel and the lower edges of said right side, front and rear panels when said crotch panel is secured to said tubular shaped garment to form a panty style garment.

2. The garment of claim 1 wherein said right and left elastic means each include at least one generally triangular elastic insert extending from said lower edge of said garment vertically upwardly a distance at least approximating the height of said slit, said inserts being oriented to provide gradually increasing elasticity in a thigh-encircling direction as said lower edge of said tubular garment is approached.

3. The garment of claim 2 wherein said left and right side panels respectively include left and right elongated slots each defined by a pair of opposite side edges extending vertically to approximately the upper edge of said garment from a point located at a distance from said lower edge approximating the height of said slit in said front panel, left and right adjustable lacing means interconnecting said pair of opposite side edges of said left and right slots, respectively, to facilitate adjusting the circumferential dimension of said tubular garment, and said left and right elastic means each including a central elastic insert located below its respectively associated slot from the lower edge thereof downwardly to said lower edge of said tubular garment, said left and right elastic means each further including at least two triangular inserts disposed on opposite sides of its respectively associated left and right central elastic insert.

4. The garment of claim 3 further including at least two elongated vertically disposed stays secured to said rear panel at horizontally spaced locations, said stays extending between approximately said upper edge of said tubular garment and said second fastener means.

5. The garment of claim 1 further including at least two elongated vertically disposed stays secured to said rear panel at horiziontally spaced locations, said stays extending between approximately the upper edge of said tubular garment and said second fastener means.

6. The garment of claim 2 further including at least two elongated vertically disposed stays secured to said rear panel at horizontally spaced locations, said stays extending between approximately the upper edge of said tubular garment and said second fastener means.

* * * * *